US006308627B1

(12) United States Patent
König et al.

(10) Patent No.: US 6,308,627 B1
(45) Date of Patent: Oct. 30, 2001

(54) METHOD FOR REMOVING AND INSERTING A CLEANING DEVICE, RESPECTIVELY, INTO AND OUT OF A PRINTING MACHINE, AND A PRINTING MACHINE FOR PERFORMING THE METHOD

(75) Inventors: Werner König, Mannheim; Rolf Kündgen, Eppelheim; Gerd Merkel, Dielheim; Bernd Sitzmann, Heidelberg, all of (DE)

(73) Assignee: Heidelberger Druckmaschinen AG, Heidelberger (DE)

( * ) Notice: Subject to any disclaimer, the term of this patent is extended or adjusted under 35 U.S.C. 154(b) by 0 days.

(21) Appl. No.: 09/472,056

(22) Filed: Dec. 23, 1999

(30) Foreign Application Priority Data

Dec. 24, 1998 (DE) ..... 198 60 191

(51) Int. Cl.[7] ..... B41L 41/00
(52) U.S. Cl. ..... 101/425; 101/423; 15/256.51
(58) Field of Search ..... 101/425, 423, 101/424; 15/256.51, 256.52

(56) References Cited

U.S. PATENT DOCUMENTS

| | | | |
|---|---|---|---|
| 5,105,740 | 4/1992 | Loos et al. | 101/425 |
| 5,622,112 | 4/1997 | Kusch et al. | 101/423 |
| 5,769,461 | 6/1998 | Hildebrandt et al. | 285/29 |
| 5,996,495 * | 12/1999 | Hara | 101/425 |

FOREIGN PATENT DOCUMENTS

| | | |
|---|---|---|
| 37 44 800 A1 | 6/1989 | (DE) . |
| 39 09 119 A1 | 9/1990 | (DE) . |
| 44 22 612 C1 | 6/1995 | (DE) . |
| 196 09 737 C1 | 5/1997 | (DE) . |
| 195 06 640 C2 | 9/1998 | (DE) . |

* cited by examiner

*Primary Examiner*—John S. Hilten
*Assistant Examiner*—Kevin D. Williams
(74) *Attorney, Agent, or Firm*—Herbert L. Lerner; Laurence A. Greenberg; Werner H. Stemer

(57) ABSTRACT

A method for removing a cleaning device from a printing machine and for inserting the cleaning device or another cleaning device into the printing machine, the inserted cleaning device being secured in position in the printing machine by a fixing device, includes opening a protective covering of the printing machine and automatically inactivating the fixing device by the opening of the protective covering, removing the cleaning device from the printing machine through an opening in the printing machine exposed by the protective covering, inserting the respective cleaning device into the printing machine, and closing the protective covering and automatically activating the cleaning device by the closing of the protective covering, so that the inserted cleaning device is secured in the inserted position thereof; and a printing machine for performing the method.

12 Claims, 8 Drawing Sheets

METHOD FOR REMOVING AND INSERTING A CLEANING DEVICE, RESPECTIVELY, INTO AND OUT OF A PRINTING MACHINE, AND A PRINTING MACHINE FOR PERFORMING THE METHOD

BACKGROUND OF THE INVENTION

Field of the Invention

The invention relates to a method of removing a cleaning device from a printing machine and of inserting the cleaning device or another cleaning device into the printing machine, the inserted cleaning device being secured in the position thereof in the printing machine by a fixing device, and to a printing machine having a cleaning device that is insertable therein, and a fixing device that secures the cleaning device in position.

Cleaning devices which are used in printing machines serve for cleaning inking-unit rollers, printing-unit cylinders or sheet transfer drums and must be removed from the printing machine from time to time for maintenance purposes.

For example, in the case of a cleaning device having a collecting trough with a doctor blade affixed thereto, it is necessary to withdraw the cleaning device from the printing machine in order to remove from the collecting trough residues of printing ink which accumulate in the collecting trough.

In a cleaning device having a cleaning cloth unwindable from a clean-cloth spool and windable onto a dirty-cloth spool, it is necessary to replace the used cleaning cloth with a fresh cleaning cloth, an operation that can generally be performed only outside the printing machine, for which purpose the cleaning device has to be removed from the printing machine from time to time.

The cleaning devices reinserted into the printing machine following maintenance or servicing have to be fixed in the vicinity of the operating position thereof.

This is effected by a clamping device, in the case of a rubber-blanket washing device as is described in the published German Patent Document DE 37 44 800 A1 and, in the case of a washing device in a printing machine as is described in the published German Patent Document DE 44 22 612 C1, by retaining elements belonging to the washing device and being insertable into slot guides or coulisses on the side frame of the printing machine, the retaining elements being formed by end regions of an actuating shaft, these end regions engaging behind steps on the slot guides due to the turning of the actuating shaft from an angular position assumed by it when it is inserted into the slot guide.

Openable protective coverings are provided on printing machines, for example, in the case of printing-unit towers, for the purpose of covering the interior space of the printing unit between the side-frame walls.

In the event that the devices described in the published German Patent Documents DE 37 44 800 A1 and DE 44 22 612 C1 are to be used in a printing-unit tower having such a protective covering, at least two manipulations are required after the insertion of the device into the printing-unit tower, namely a first manipulation for securing the position of the device and a second manipulation for closing the protective covering behind the device that has been inserted and secured in position.

Large multicolor printing machines may have more than ten printing-unit towers, respectively, having two regularly maintainable devices, for each printing-unit tower, so that the operating outlay or expense adds up, and the sparing of each manipulation represents an easing of the work for the pressman.

SUMMARY OF THE INVENTION

It is therefore an object of the invention to provide an improved method for an operating-friendly deinstallation and reinstallation of a cleaning device and to provide an improved printing machine with which the method can be implemented.

With the foregoing and other objects in view, there is provided, in accordance with one aspect of the invention, a method for removing a cleaning device from a printing machine and for inserting a device selected from the group consisting of the cleaning device and another cleaning device, respectively, into the printing machine, the inserted cleaning device being secured in position in the printing machine by a fixing device, which comprises opening a protective covering of the printing machine and automatically inactivating the fixing device by the opening of the protective covering, removing the cleaning device from the printing machine through an opening in the printing machine exposed by the protective covering, inserting the respective cleaning device into the printing machine, and closing the protective covering and automatically activating the cleaning device by the closing of the protective covering, so that the inserted cleaning device is secured in the inserted position thereof.

In accordance with another aspect of the invention, there is provided a printing machine having a cleaning device insertable therein, and a fixing device for securing the inserted cleaning device in position, comprising a protective covering belonging to the printing machine and being alternatively adjustable into an open position and a closed position, the protective covering forming an actuating element of the fixing device, the fixing device being formed so as to expose the cleaning device when the protective covering is open and to hold the cleaning device firmly when the protective covering is closed.

In accordance with a further feature of the invention, the protective covering is equipped with a first guide, and with a second guide constructed for inserting the cleaning device into the printing machine, the first guide being constructed for pushing the cleaning device onto the protective covering and for inserting the cleaning device into the second guide, the first guide and the second guide being aligned in mutually intersecting directions.

In accordance with an added feature of the invention, the aligned first and second guides substantially perpendicularly abut one another.

In accordance with an additional feature of the invention, the cleaning device is constructed as a carriage slidable on the first guide and rollable on the second guide.

In accordance with yet another feature of the invention, the fixing device is constructed as a linkage formed as a double rocker arm.

In accordance with yet a further feature of the invention, the double rocker arm includes a drive rocker arm formed by the protective covering.

In accordance with an alternative feature of the invention, the double rocker arm includes a drive rocker arm swivellably coupled with the protective covering.

In accordance with yet an added feature of the invention, the double rocker arm includes a driven rocker arm whereon a first latching element is disposed which, depending upon the swivelling direction of the driven rocker arm, is bringable, due to the swivelling of the driven rocker arm, into and out of engagement, respectively, with a second latching element formed on the cleaning device.

In accordance with yet an additional feature of the invention, the double rocker arm includes a drive rocker arm formed as an angular rocker.

In accordance with still another feature of the invention, the printing machine includes a third guide for guiding the cleaning device as the cleaning device is being inserted, the third guide being formed on a side frame of the printing machine, and a first guide pin guidable by the third guide and fastened to the cleaning device, the first guide pin in a dual function also forming the second latching element.

In accordance with a concomitant feature of the invention, the printing machine includes a second guide pin having a larger diameter than that of the first guide pin, the second guide pin being fastened, in addition to the first guide pin, to the cleaning device, and being disposed downline from the first guide pin in the insertion direction.

Thus, the method of removing a cleaning device from a printing machine and of inserting the cleaning device or another cleaning device into the printing machine, the inserted cleaning device being secured in position in the printing machine by a fixing device, is distinguished by the fact that, in a first method step, a protective covering of the printing machine is opened and the fixing device is automatically inactivated by the opening operation, in a second method step, the cleaning device is removed from the printing machine through an opening in the printing machine exposed by the protective covering, in a third method step, the cleaning device or the other cleaning device is inserted into the printing machine, and in a fourth method step, the protective covering is closed and the fixing device is automatically activated by the closing operation, so that the inserted cleaning device is secured in the inserted position thereof.

One advantage of the method according to the invention is that virtually only a single action, for example, folding up the protective cover or pulling it to into a closed position, or pressing a single operating knob which triggers these actions is necessary, in order to secure the cleaning device in position at the same time as covering the opening of the printing machine. When the protective covering is opened, the securing of the cleaning device in position is simultaneously canceled, so that the cleaning device can be removed without any delay.

The actions of opening and closing the protective covering can be assisted by a motor and, for example, can be effected by a pneumatic cylinder due to pressing on a knob. It is preferable for the pressman to open and close the protective covering manually, without motor assistance.

In the third method step, the cleaning device removed from the printing machine in the second method step can be inserted into the printing machine again. This variation is expedient if maintenance work to be performed on the cleaning device between the second and third method steps can be carried out quickly. If, however, the maintenance work requires a greater outlay of time, a variation is more expedient, wherein, in the third method step, instead of the cleaning device being removed for maintenance, a replacement device that is kept ready is inserted into the printing machine, so that the printing operation can be continued without delay due to the rapid replacement of the cleaning devices.

The printing machine having a cleaning device that is insertable therein, and a fixing device securing the inserted cleaning device in position is especially suitable for implementing the method according to the invention, and is distinguished by the fact that a protective covering which belongs to the printing machine and can alternatively be adjusted into an open position and a closed position forms an actuating element of the fixing device, the latter being constructed so as to expose the cleaning device when the protective covering is open and to hold the cleaning device firmly when the protective covering is closed.

The fixing device can act so as to block or inhibit an inadvertent change in position of the cleaning device. In the preferred first-mentioned variation, the fixing device is a locking device that acts in a positively locking or formlocking manner, the locking device being locked when the protective covering is closed and unlocked when the protective covering is open. In the second-mentioned variation or exemplary embodiment, the fixing device is a clamping device that acts in a friction-locking manner and clamps the cleaning device firmly when the protective covering is closed, and does not clamp it firmly when the protective covering is open. By both types of fixing device, the position of the cleaning device can be fixed in a standby position that is close to a cylinder to which the cleaning device is assigned for the purpose of cleaning it.

This cylinder may be a printing-unit or varnishing-unit cylinder, a sheet transfer drum or an inking-unit roller. The cleaning device may have a doctor blade, a brush roller or a cleaning cloth as an effective cleaning element which can be pressed against the cylinder.

The printing machine is preferably constructed as a rotary offset printing machine having a rubber blanket cylinder to which there is assigned the cleaning device, which is constructed as a washing device having a cloth that can be unwound and wound up, and that is bringable into contact with the blanket cylinder of the printing machine.

Other features which are considered as characteristic for the invention are set forth in the appended claims.

Although the invention is illustrated and described herein as a method for removing and inserting a cleaning device, and a printing machine for performing the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
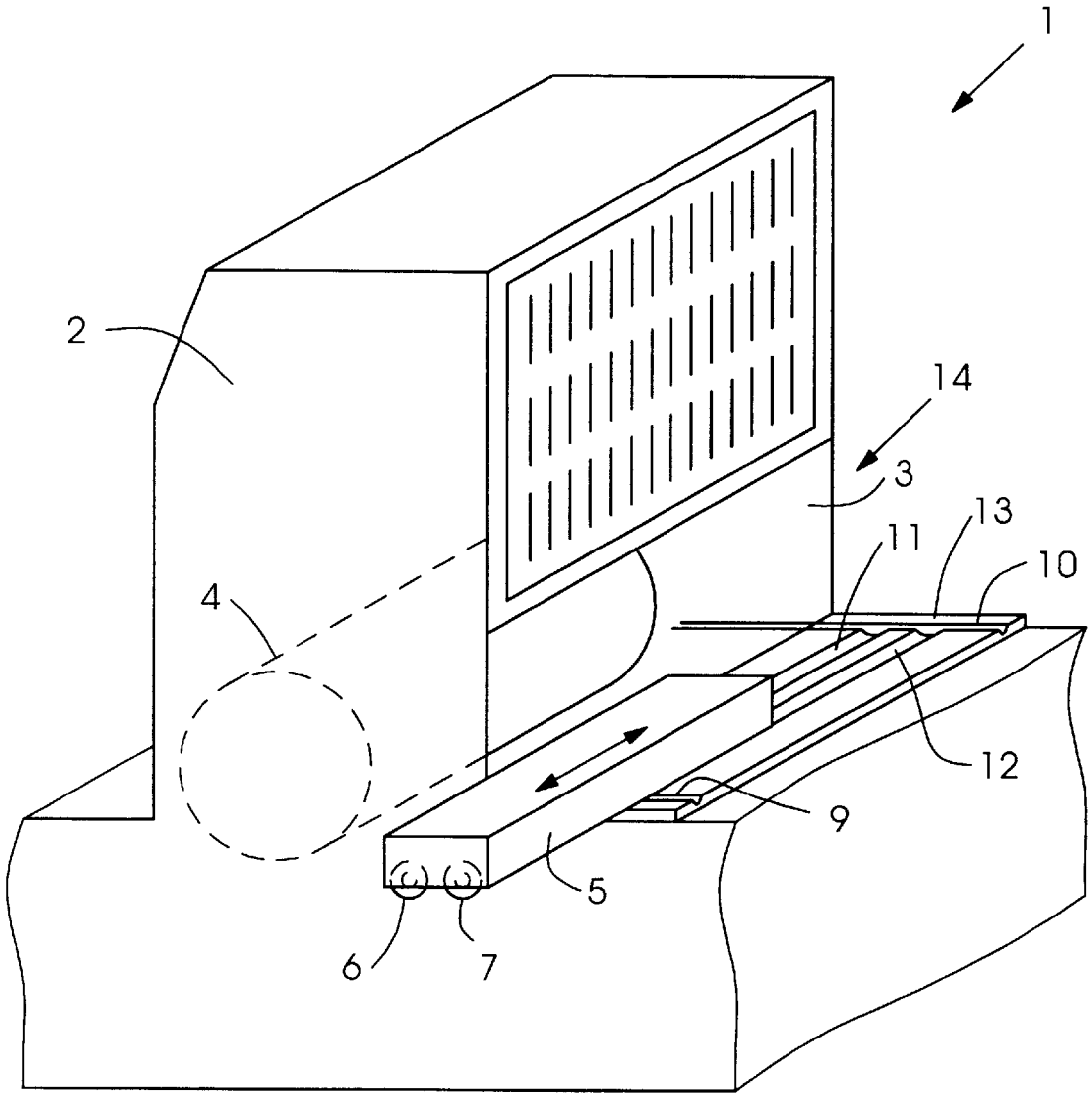
FIG. 1 is a diagrammatic perspective view of a printing unit having a protective covering whereon a transverse guide is arranged, along which a cleaning device is pushed onto the protective covering.

Referring now to the drawings and, first, particularly to FIG. 1 thereof, there is illustrated therein a rotary offset printing machine 1 having a printing unit with two side walls 2 and 3, between which a printing-unit cylinder 4 is rotatably mounted. The printing-unit cylinder 4 is a blanket cylinder that picks up the printing ink from a non-illustrated printing-plate cylinder that is in contact with the printing-unit cylinder 4 and transfers the printing ink to the front side of the printing material which rests then by the rear side thereof on a non-illustrated impression cylinder. The printing unit is openable and closable by a protective covering 13.

The protective covering 13 is formed as a protective flap 13 that is pivotable about a rotary joint 20 (note FIG. 7) from a vertical position into a horizontal position as shown in FIG. 1. The protective covering 13 located in the horizontal position serves as a supporting table for the cleaning device 5. For this purpose, the protective covering 13 is equipped with a first guide 11, 12 and with a second guide 9, 10 provided for the insertion of the cleaning device 5 into the printing machine 1. The first guide 11, 12 serves for pushing or sliding the cleaning device 5 onto the protective covering 13 and for inserting the cleaning device 5 into the second guide 9, 10. The first guide 11, 12 and the second guide 9, 10 are linear guides which are aligned in mutually intersecting directions and abut one another approximately perpendicularly.

The second guide 9, 10 is formed of two longitudinal rails 9 and 10 extending parallel to one another and being embedded in the protective covering 13. The longitudinal rails 9 and 10, respectively, are formed with a longitudinal groove wherein the rollers 6, 7 and 8 guidingly run. As viewed in a cross section of the longitudinal rails 9 and 10 (note FIG. 2), the longitudinal grooves have a trapezoidal shape and can also have a V-shaped slotted profile.

The first guide 11, 12 is formed of two mutually parallel transverse rails 11 and 12, which are embedded in the protective covering 13 sprocketlike between the longitudinal rails 9 and 10. The transverse rails 11 and 12 have concavely rounded profiled grooves extending in the longitudinal direction thereof, and can also have a U-shaped or L-shaped profile. The transverse rails 11 and 12, respectively, terminate at both of the ends thereof in the corresponding longitudinal rail 9 and 10, respectively.

Figure 2:
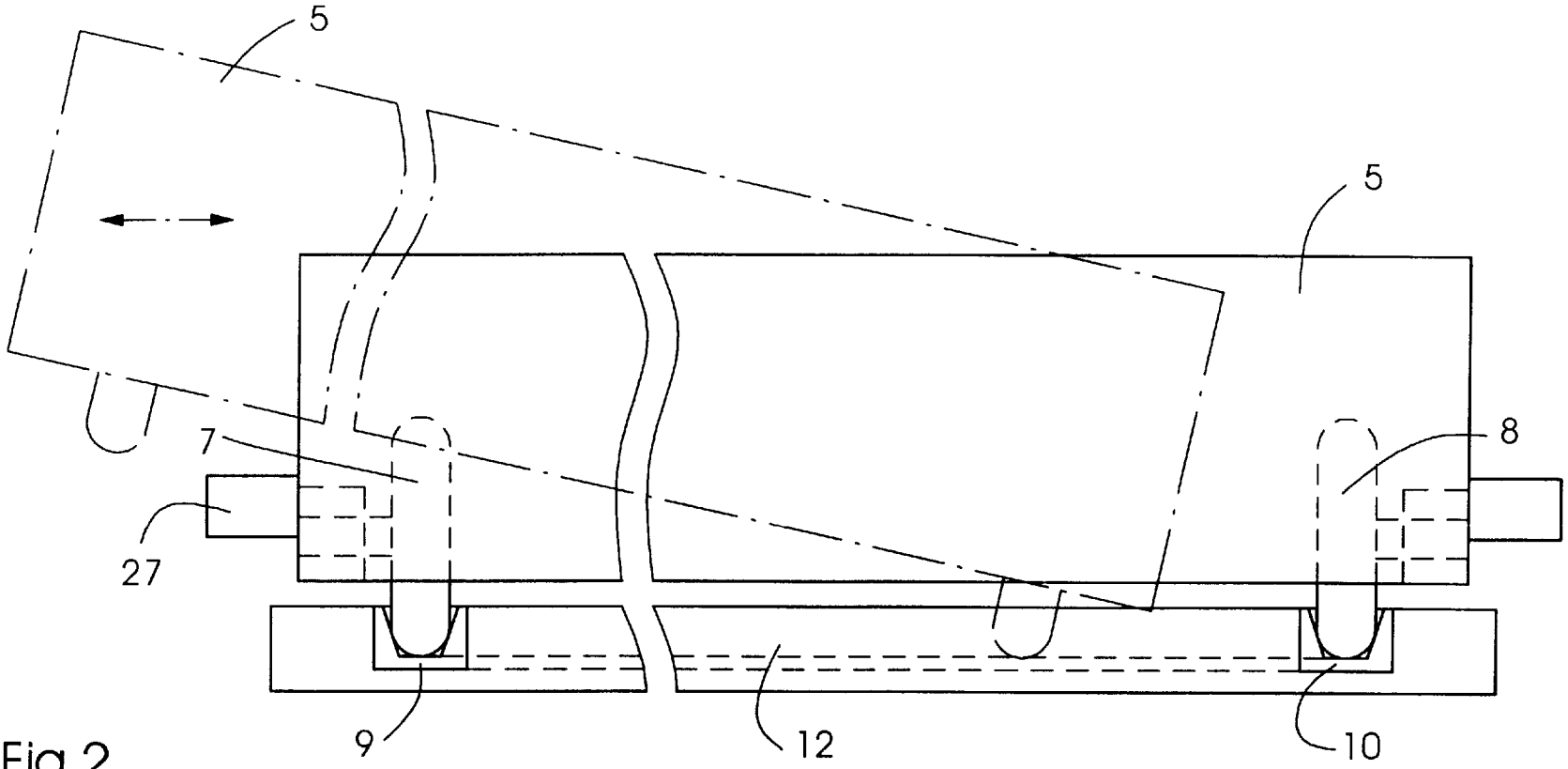
FIG. 2 is an enlarged fragmentary view of FIG. 1 as seen from the righthand side of the protective covering shown therein, while the cleaning device is being pushed onto the protective covering in a transverse direction.

The cleaning device 5 is constructed as a carriage sliding on the first guide 11, 12 and rolling on the second guide 9, 10. Close to the front end of the cleaning device 5, two rollers 6 and 7 mutually offset axially are arranged on the cleaning device. Close to the rear end of the cleaning device 5, coaxial with the rollers 6 and 7, a further roller pair is arranged, which is covered in FIG. 1 by the cleaning device 5 and of which only one roller 8 can be seen in the view on which FIG. 2 is based. The axial spacing of the rollers 6 and 7 from one another, and also of the further rollers 8 from one another, corresponds to the spacing of the rails 11 and 12 from one another. The spacing of the rails 9 and 10 from one another determines the track width of the carriage 5 and the spacing of the rollers 6 and 7 from the rollers 8.

The insertion of the cleaning device 5 into the printing machine 1 is made easier by the fact that the pressman can first rest the rear end of the cleaning device 5 having the rollers 8, on the protective covering 13, indeed in such a way that the two rear rollers 8 are guided into the transverse rails 11 and 12. It is thereby advantageous that the pressman does not have to hold at both ends the cleaning device 5, the length of which corresponds approximately to the axial length of the cylinder 4. Holding the cleaning device 5 at both ends is very awkward, particularly in the case of very long and heavy cleaning devices 5 on printing machines with a large format width. In the printing machine 1 according to the invention, the pressman is able to push onto the protective covering 13 the cleaning device 5, which is already supported at the rear end thereof by the protective covering 13, while holding the front end of the cleaning device with both hands, the cleaning device 5 being guided by the first guide 11, 12.

FIG. 2 shows that the pressman can tilt the cleaning device 5 slightly as it is being pushed or slid in the transverse direction, so that only the two rear rollers 8, respectively, slide in a transverse rail 11, 12, virtually without rotating. The circumferential direction of the rollers 6, 7 and 8 is perpendicular to the guiding direction of the transverse rails 11 and 12. The phase of pushing or sliding the cleaning device 5 along the first guide 11, 12 is illustrated in phantom, i.e., by dot-dash lines, in FIG. 2.

When the cleaning device 5 is being pushed or slid on in the longitudinal direction of the grooves formed in the transverse rails 11 and 12, respectively, the rollers 8 are pushed out of the grooves in the transverse rails 11 and 12, which are open at the ends thereof, through trough-like mouth openings in that side wall of the longitudinal rail 10 that faces the longitudinal rail 9, perpendicularly to the longitudinal direction of the groove formed in the longitudinal rail 10 into the groove formed in the latter, until the rollers 8 strike the other side wall of the longitudinal rail 10. The front end of the cleaning device 5 can then also be placed onto the protective covering 13, and the rollers 6 and 7 can be placed in the groove formed in the longitudinal rail 9.

The longitudinal rail 9 is also connected to the respective transverse rail 11 and 12, respectively, via a trough-like mouth opening, so that when the cleaning device 5 is pulled down by the protective covering 13, the rollers 8 can enter the longitudinal rail 9, which acts as a stop. This prevents the rear end of the cleaning device 5 from slipping off the protective covering 13 when the pressman pulls the cleaning device 5 too energetically at the front end thereof. In FIG. 2, solid lines are used to illustrate the cleaning device 5 in an intermediate position, wherein the cleaning device 5 is already being guided at both ends by the second guide 9, 10, but is not located opposite the first guide 11, 12.

Figure 3:
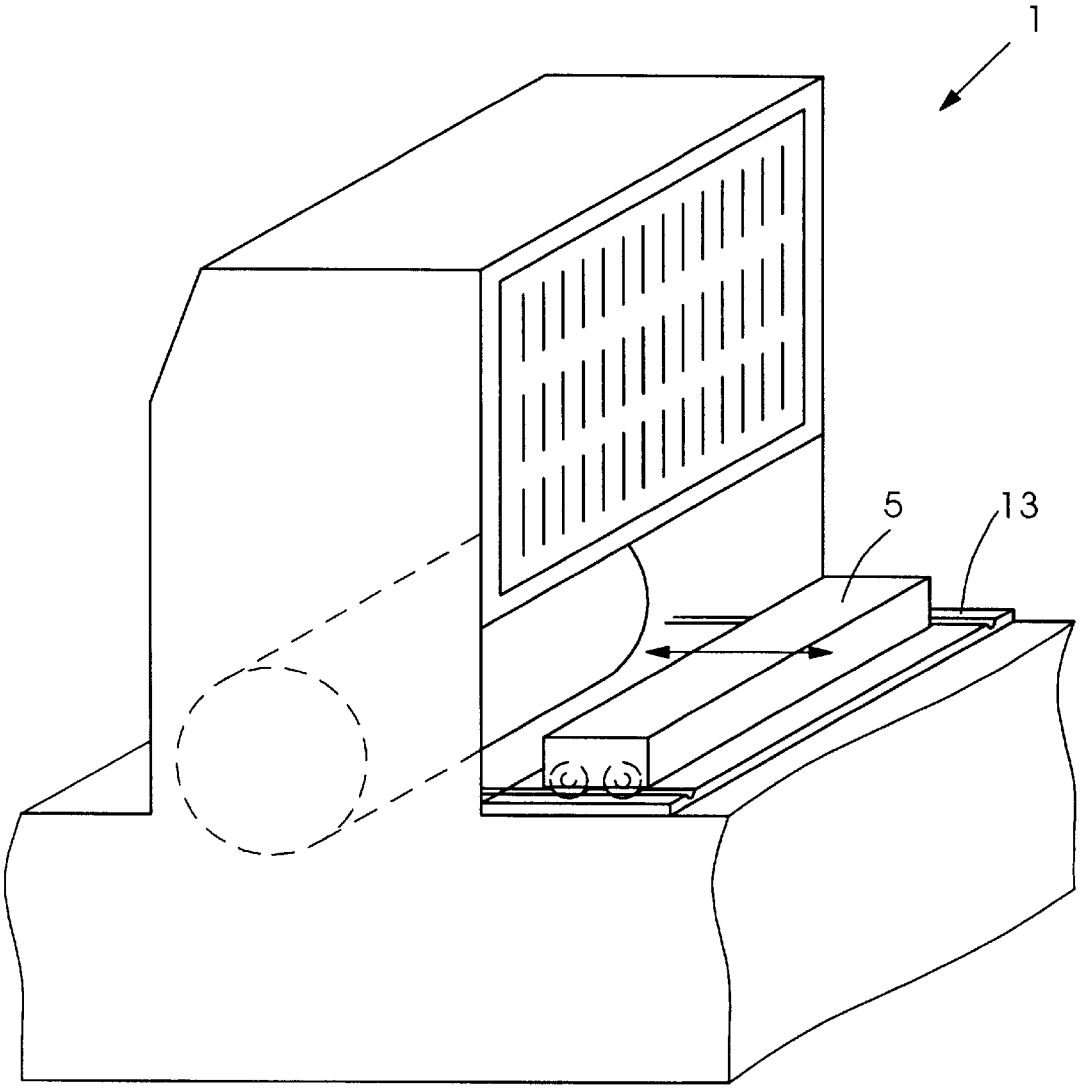
FIG. 3 another view similar to that of FIG. 1, but showing the cleaning device during the insertion thereof into the printing unit along a longitudinal guide arranged on the protective covering.

FIG. 3 illustrates the operation of inserting the cleaning device 5 from the intermediate position into the printing machine 1 along the second guide 9, 10. As the cleaning device 5 is inserted in the standby position thereof on the cylinder 4, the cleaning device 5 rolls with the rollers 6 and 7 in the longitudinal rail 9, and with the rollers 8 in the longitudinal rail 10, so that the pressman can place the cleaning device 5 in the printing machine 1 without exerting any great effort.

Figure 4:
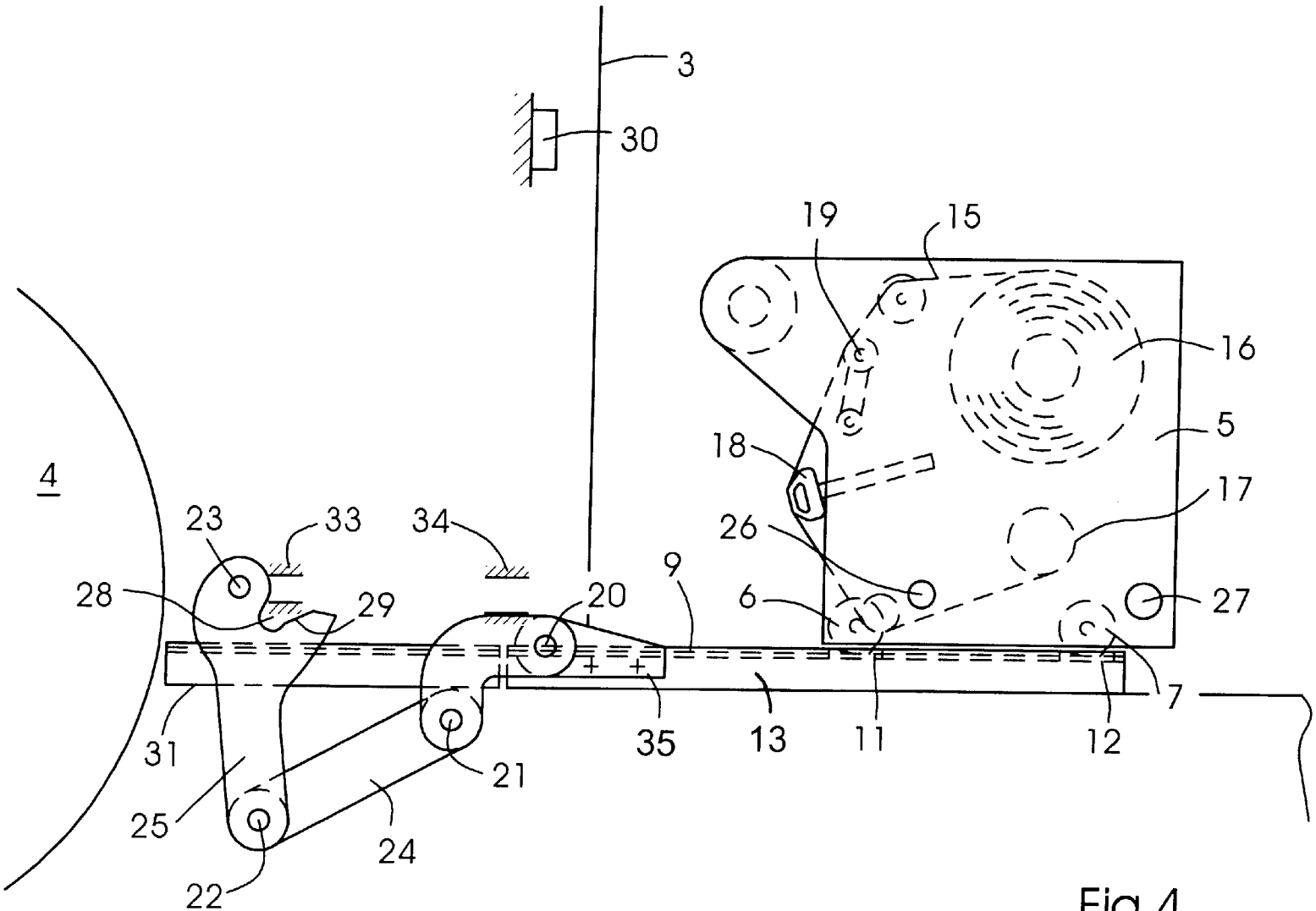
FIG. 4 is an enlarged fragmentary view of FIG. 3 showing the protective covering, the cleaning device and a fixing device coupled to the protective covering in an inactive and non-securing position.

FIG. 4 illustrates the cleaning device 5 in detail. The cleaning device 5 is constructed as a so-called cloth washing device 5 and includes, as the effective cleaning element thereof, a cleaning cloth 15 having a clean, unused part stored on an unwinding spool 16, and a dirty, used part windable on a rewinding spool 17. The cleaning cloth 15 is guided over a moistening tube 19 having outlet openings for the cleaning fluid carried therein, for impregnating the cleaning cloth 15 with a cleaning agent, and over a pressing element 18 for pressing the cleaning cloth 15 onto the circumferential face of the cylinder 4. Instead of the moistening tube 19, other cleaning-fluid feeding devices, for example, s pray nozzles for spraying the cleaning fluid directly onto the cylinder, can also be used. The pressing element 18 is constructed as a pressing cushion 18 in the form of a bar-like, resilient hollow profile. The width of the cleaning cloth 15 and the length of the pressing element 18 correspond approximately to the axial length of the cylinder 4 to be cleaned.

The second guide 9, 10 has a bipartite construction in the longitudinal direction thereof, and includes extension pieces 31 and 32 belonging to the longitudinal rails 9 and 10 and installed in the printing machine 1 so that they are fixed with respect to the frame. The gap dimension in the longitudinal rails 9 and 10 and the longitudinal rail extensions 31 and 32 thereof are, on the one hand, to be dimensioned so generously that there is sufficient clearance for the terminating ends of the longitudinal rails 9 and 10 to pivot past, and, on the other hand, are dimensioned so closely that the cleaning device 5 can be moved from the longitudinal rails 9 and 10 onto the longitudinal rail extensions 31, 32 without rattling noticeably in the process or even becoming tuck or remaining suspended.

The cleaning device 5, which is illustrated in the intermediate position thereof in FIG. 4, has a fixing device 35, 20 to 29 assigned thereto, which is constructed as a linkage or link mechanism in the form of a double rocker. In principle, other flat types of linkages or link mechanisms of the so-called four swivel joint chain, i.e., rocker cranks, double cranks and parallel cranks, may be used for transmitting the fixing movement. The fixing device 35, 20 to 29 illustrated in FIG. 4 is assigned to the front end of the cleaning device 5. A further fixing device not illustrated in FIG. 4 but of identical construction to the fixing device 13, 20 to 29, is assigned to the rear end of the cleaning device 5, so that the latter can be held firmly on both sides in the standby position thereof (note FIG. 7). The further fixing device operates synchronously with the fixing device 35, 20 to 29 shown, and does not have to be described specially.

The link mechanism 35, 20 to 25 includes a first swivel joint 20 that is fixed relative to the frame and about which a drive rocker 35, formed by the protective covering 13, can be pivoted, a displaceable second swivel joint 21 for the hinged connection of the drive rocker 35 to a linking element 24, a displaceable third swivel joint 22 for the hinged connection of the coupling element 24 to a driven rocker 25, and a fourth swivel joint 23 that is fixed relative to the frame and about which the driven rocker 25 can be pivoted. The drive rocker 13 of the double rocker 35, 20 to 25, constructed as an angular rocker 35, is formed directly by the protective covering 13 and, in an alternative embodiment, can also be coupled to the covering so as to be pivotable. In the last-mentioned case, for example, a drive rocker that is arranged so as to be offset in relation to the protective covering 13 in the axial direction of the swivel joint 20 can have a driven connection with the protective covering 13 by a hinged pin of the swivel joint 20 forming a drive shaft that concomitantly pivots or swivels the offset driven rocker when the protective covering 13 is pivoted or swivelled.

The mean spacing of the first articulating joint 20 from the second articulating joint 21 is smaller than the mean spacing between the second articulating joint 21 and the third articulating joint 22, and is also smaller than the mean spacing between the third articulating joint 22 and the fourth articulating joint 23. The mean spacing of the second articulating joint 21 from the third articulating joint 22 is smaller than the mean spacing of the third articulating joint 22 from the fourth articulating joint 23. The angular portion of the drive rocker arm 35 is an extension of a lateral frame part of the protective covering 13 that forms the drive rocker arm 35. The protective covering 13 and, with the latter, the entire link mechanism 35, 20 to 25, is held in the position shown in FIG. 4 by that part of the protective covering 13 that serves as a support table resting, due to the inherent weight thereof, on a forward construction of the printing unit or on an intermediate construction between two printing units. In this position, the drive rocker arm 35, starting from the first joint 20, initially extends a little in the horizontal direction and, following the approximately perpendicular portion, extends a little farther in the vertical direction as far as the second joint 21. That part of the drive rocker arm 35 that is located between the joints 20 and 21 forms a somewhat angular piece with equal arms. The length of that part of the drive rocker arm 35 that is not angular and that serves as the supporting table is a multiple of, for example, approximately four times the spacing between the joints 20 and 21. When the drive rocker arm 35 is pivoted by the pressman acting upon the long lever arm, it is possible for the pressman to exert a comparatively high force for positioning and fixing the cleaning device 5 without great effort, due to the lever action.

The fixing device 35, 20 to 29 is constructed as a locking device, there being arranged on the driven rocker arm 25 of the double rocker arm 35, 20 to 25 a first latching element 28 which, depending upon the pivoting direction of the driven rocker arm 25, can be brought into or out of engagement with a second latching element 26 formed on the cleaning device 5, due to the pivoting of the driven rocker arm 25. In this way, a locking of the cleaning device 5 by the driven rocker arm 25 is effected, it being performed forcibly with the operation of closing the protective covering 13. The first latching element 28 is constructed as a catching claw in the form of a latching groove 28 that encloses the second latching element 26 when it is locked. The second latching element 26 is a latching pin that can be fastened to the cleaning device 5. In specific cases, a hooking in a converse arrangement can also be provided, wherein the latching groove is formed on the cleaning device 5, and the latching pin is fastened to the driven rocker arm 25.

An advantage of the illustrated embodiment is that a third guide 33, 34 guiding the cleaning device 5 as it is inserted is formed on a side frame 2, 3 of the printing machine 1, and a first guide pin 26 guided by the third guide 33, 34 and fastened to the cleaning device 5 also forms the second latching element 26, in a dual function. The third guide 33, 34 extends parallel to the second guide 9, 10 and, in a duplicated construction, is arranged on both sides of the cleaning device 5. The third guide 33, 34 guides the cleaning device as it is being inserted into the printing machine 1 in the horizontal direction, and effects the securing of the cleaning device 5 in the inserted position thereof (FIG. 7) in the vertical direction.

This is achieved by the entry of the first guide pin 26, guided directly by the third guide 33, 34, into a guide groove that extends in the horizontal direction in the side frame 2 as the cleaning device 5 is inserted into the printing machine 1, and by the guidance of the first guide pin 26 in the guide groove. In an alternative embodiment, instead of the guide groove on the side frame 2, there can be provided a guide rail extending in the horizontal direction and engaging over the first guide pin 26 or a comparable guide element as the cleaning device 5 is inserted, and holding the cleaning device 5 from above in reliable contact on the second guide 9, 10. Also formed on the side frame 3 is a third such guide, which guides the bar-like cleaning device 5 at the rear end thereof, so that the cleaning device 5 is guided at both ends. Of course, the guides 9, 10 and 33, 34 can also be arranged to be inclined slightly, instead of being horizontal, so that the cleaning device 5 rolls into the printing machine 1 as though on an inclined plane.

A second guide pin 27 that has a greater diameter than that of the first guide pin 26 is preferably fastened to the cleaning device 5, beside the first guide pin 26 and downline in the insertion direction. The guide pins 26 and 27 are not only arranged so as to be offset in relation to one another in the horizontal direction but are also arranged to be offset slightly, for example, a few millimeters, in relation to one another in the vertical direction on the outside of a lateral housing wall of the cleaning device 5. The third guide 33, 34 has a bipartite construction, matched to the different diameters of the guide pins 26 and 27, so that a subregion 34 of the third guide 33, 34 that is located distally from the cylinder 4 permits the smaller guide pin 26 to pass through easily with a large clearance from the subregion 34. As the cleaning device 5 is inserted farther in the direction of the cylinder 4, the smaller guide pin 26 passes into a narrowed subregion 33 arranged downline of the subregion 34 and is guided comparatively tautly by the latter with little play. At the same time, the larger guide pin 27 passes into the subregion 34, and is likewise guided comparatively tautly by the latter. In this way, the cleaning device 5 can be inserted and positioned very easily, but nevertheless secure against tilting, in the standby position thereof on the cylinder 4.

Securing the position of the cleaning device 5 in the vertical direction is thus effected by the third guide 33, 34, while securing the position thereof against inadvertent displacement of the cleaning device 5 in the horizontal direction is effected by the fixing device 35, 20 to 29.

Figure 5:
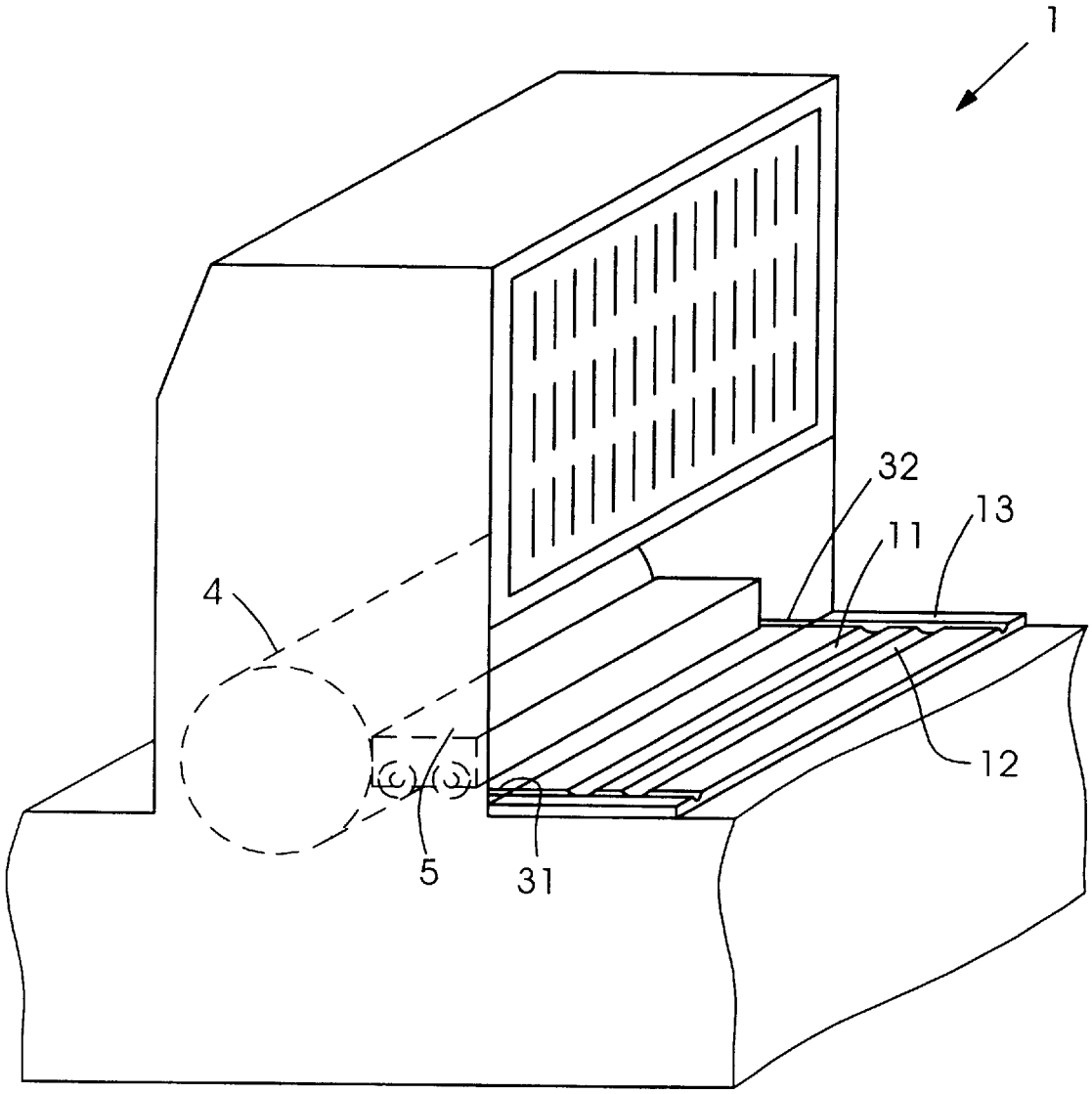
FIG. 5 is a further view similar to that of FIG. 3, but showing the cleaning device after the complete insertion thereof into the printing unit, the cleaning device being in a standby position close to the cylinder of the printing unit while the protective cover remains open.
Figure 6:
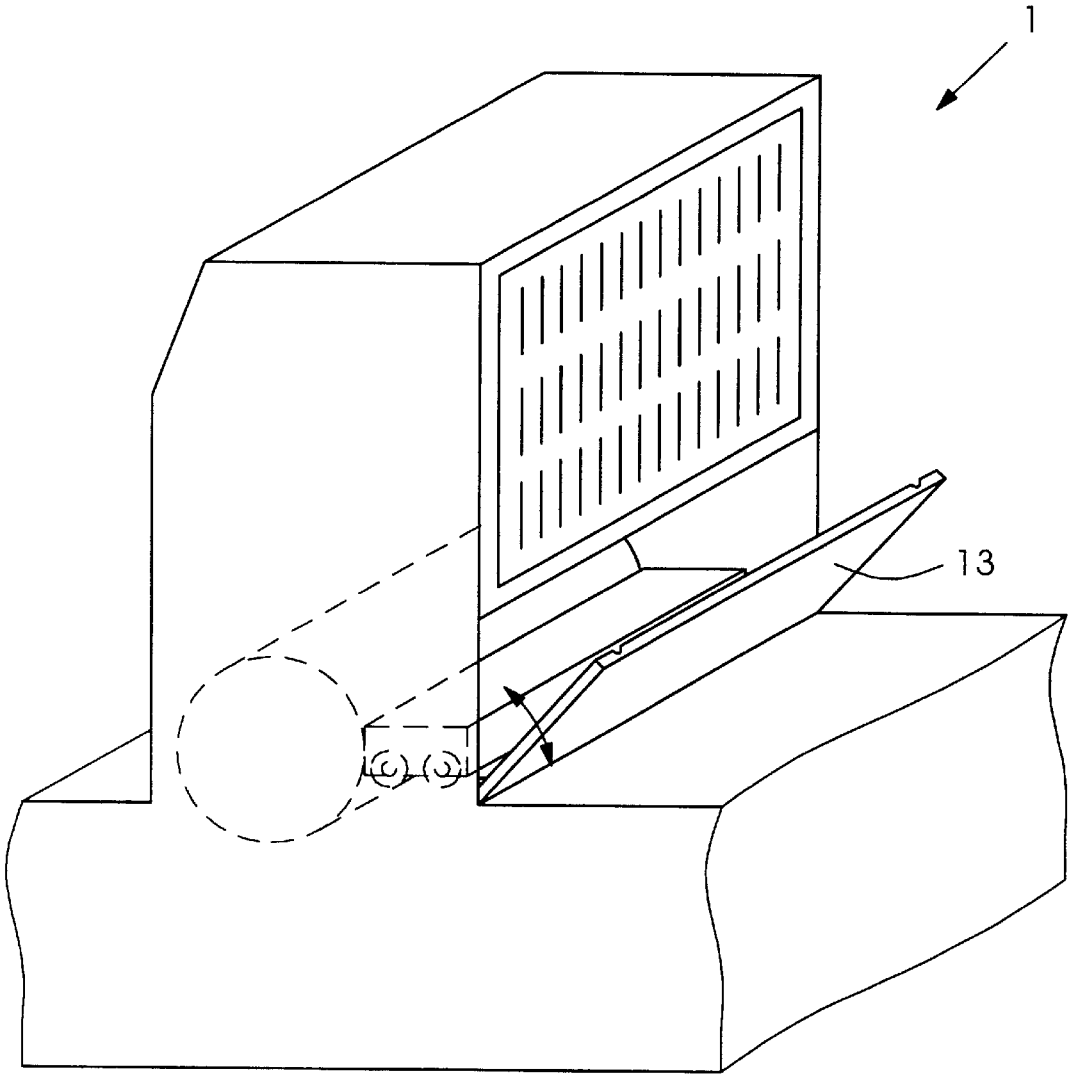
FIG. 6 is an added view similar to that of FIG. 5, but showing the closing of the printing unit by the protective covering, with the cleaning device inserted into the printing unit.

In FIG. 5, the cleaning device 5 has already been inserted into the printing machine 1 to such an extent that the cleaning device S abuts an end stop limiting displacement along the second guide 9, 10 or directly abuts the cylinder 4. When the cleaning device 5 is located in this position, the protective covering 13 can be closed behind the cleaning device 5, when the pressman pivots or swivels the protecting covering 13 upwardly by hand, as illustrated in FIG. 6.

In the event that the cleaning device 5 is not located quite at the end of the second guide 9, 10 or, following the insertion, has rolled back a little from the cylinder 4, a chamfer 29 provided on the fixing device 35, 20 to 29 effects a positional correction of the cleaning device 5 into the position necessary for fixing. When the protective covering 13 is closed, it, or the drive rocker arm 35 formed thereby, is pivoted or swivelled in the counterclockwise direction about the first swivel joint 20. The coupling element 24 transmits this pivoting or swivelling movement to the driven rocker arm 25 which, as a result, is likewise pivoted or swivelled in the counterclockwise direction about the fourth swivel joint 23. As a result of the pivoting or swivelling of the driven rocker arm 25, the chamfered groove side 29 thereof presses like a thrust wedge onto the latching element 26 and displaces the latter, and therefore the cleaning device 5, into the correct end position, i.e., to the lefthand side as referred to FIG. 4. As the rocker arms 35 and 25 are pivoted or swivelled further in the counterclockwise direction, the latching groove 28 is slipped completely over the second latching element 26 from beneath, the second latching element 26 being introduced from the groove region, widened by the chamfered groove side 29, into a groove region of the latching groove 28 that encloses the latching element 26 tautly, and the cleaning device 5 is locked.

Figure 7:
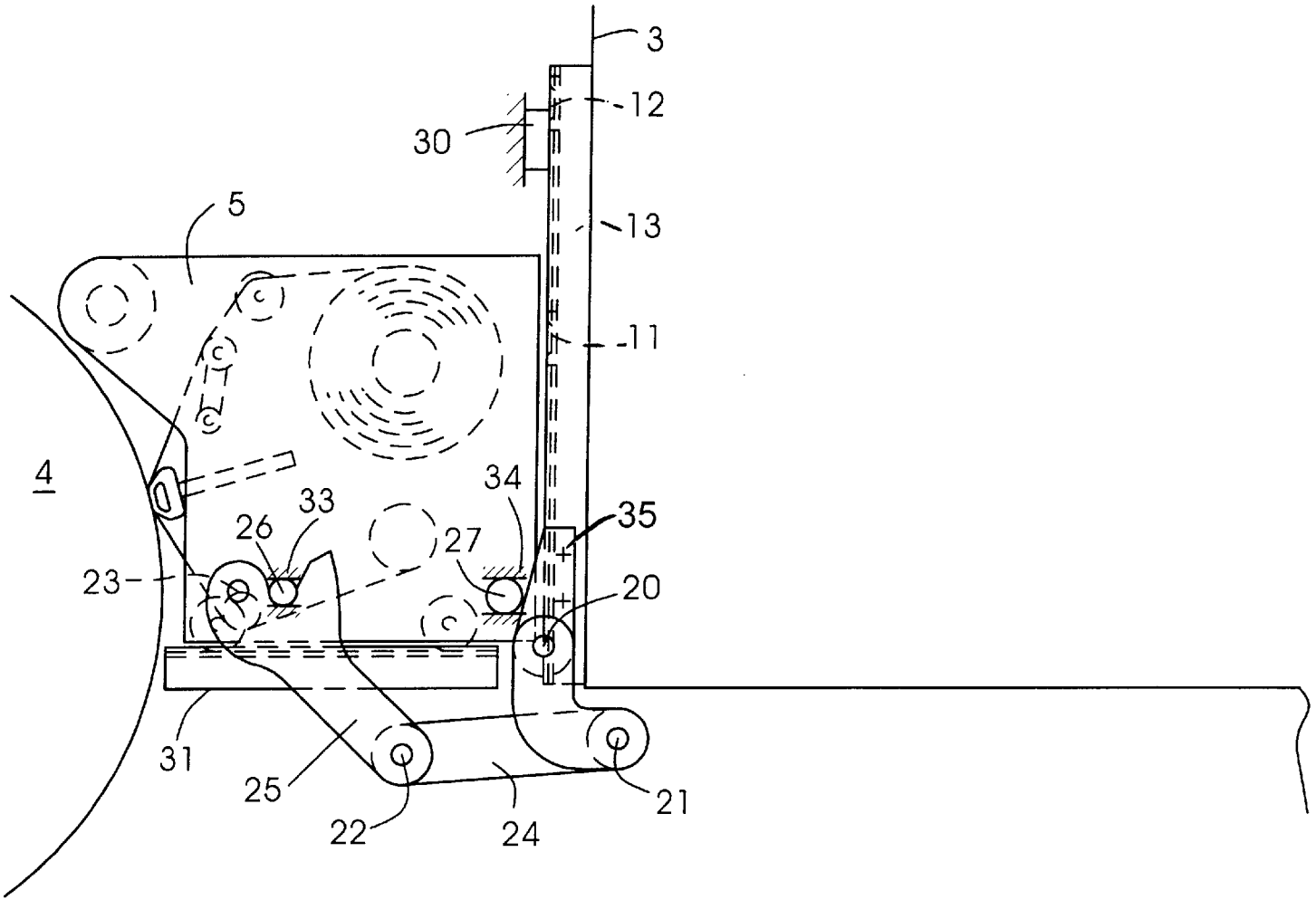
FIG. 7 is a view similar to that of FIG. 4, but showing the cleaning device, the protective covering and the fixing device, the cleaning device being in the process of cleaning the cylinder, the protective covering being completely closed behind the cleaning device, and the fixing device being located in an active position for securing the cleaning device in the standby position thereof.

FIG. 7 illustrates how the latching groove 28, that is open at the top in the position shown, encloses the second latching element 26 on both sides and, as a result, the cleaning device 5 is locked against any displacement to the righthand or lefthand sides. The completely closed protective covering 13 is here located in the vertical position thereof and is held in the closed position by a securing device 30, which is formed as a magnetic closure having a permanent magnet fastened to the printing machine 1.

Figure 8:
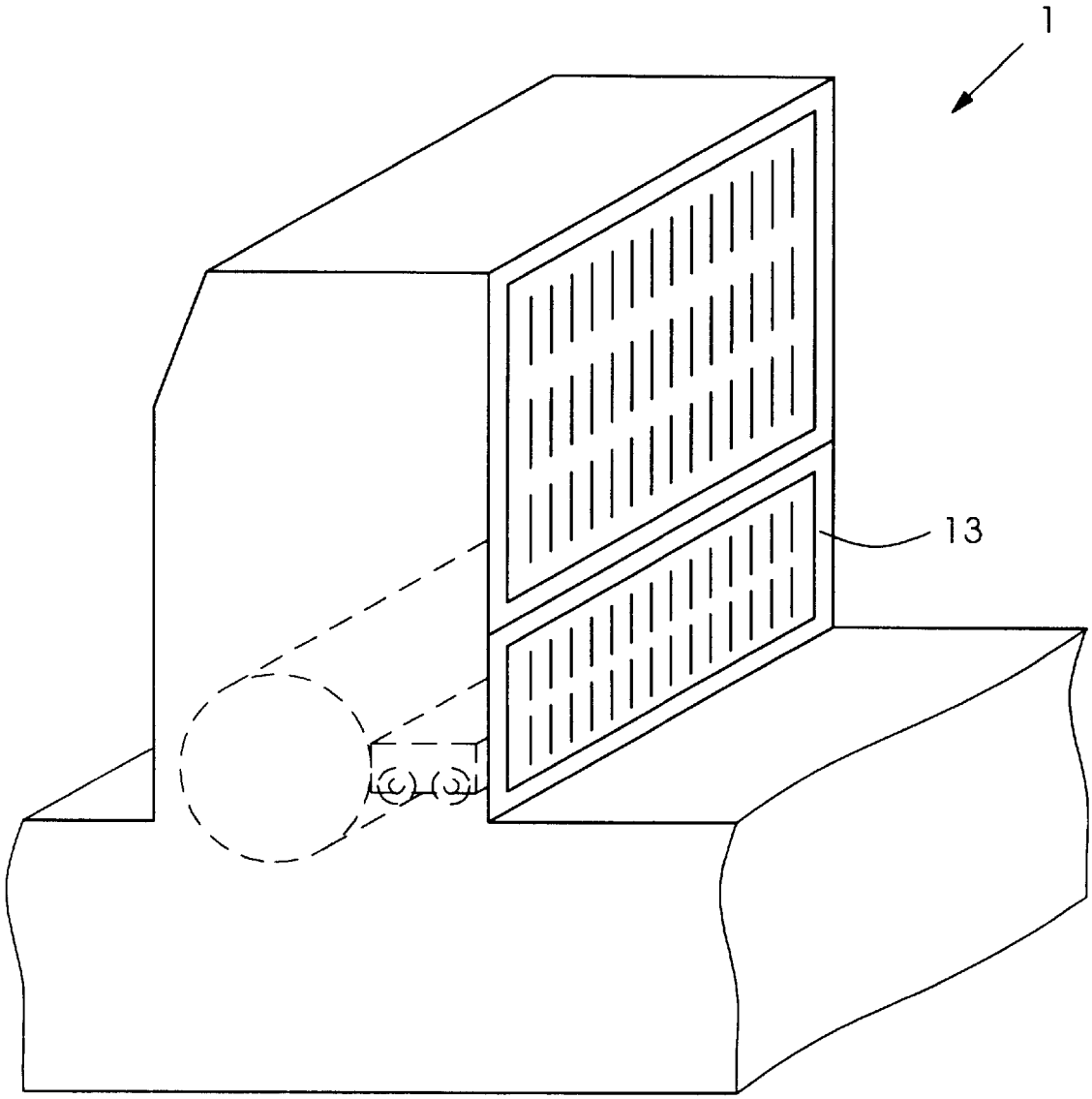
FIG. 8 is a view similar to that of FIG. 5, but showing the exterior of the printing unit with the protective covering closed.

The completely closed protective covering 13 is shown in FIG. 8.

The removal of the cleaning device 5 from the printing machine 1 is performed in a converse sequence to that of the aforedescribed insertion of the cleaning device 5. After the opening of the protective covering 13, by which the fixing device 35, 20 to 29 is unlocked at the same time, the cleaning device 5 can be rolled out of the printing machine 1 along the second guide 9, 10. When the rollers 8 of the cleaning device 5 are located in the region of the mouth transitions of the transverse rails 11 and 12 into the longitudinal rail 10, the cleaning device 5 can be tilted upwardly slightly at the front end by the pressman, as shown in FIG. 2, and pulled off the protective cover 13 in the lateral direction along the first guide 11, 12.

We claim:

1. A method for removing a cleaning device from a printing machine and for inserting an insertable device selected from the group consisting of the cleaning device and another cleaning device, respectively, into the printing machine, the insertable device being secured in position in the printing machine, after being inserted, by a fixing device, which comprises:

opening a protective covering of the printing machine and automatically inactivating a fixing device by the opening of the protective covering, removing a cleaning device from the printing machine through an opening in the printing machine exposed by the protective covering, inserting an insertable device selected from the group consisting of the cleaning device and another cleaning device, into the printing machine, and closing the protective covering and automatically activating the fixing device by the closing of the protective covering, so that the insertable device is secured in an inserted position thereof.

2. A printing machine having a cleaning device insertable therein, and a fixing device for securing the inserted cleaning device in position, comprising: the fixing device being constructed as a linkage; and a protective covering belonging to the printing machine and being alternatively adjustable into an open position and a closed position, said protective covering forming an actuating element of the fixing device so that the fixing device exposes the cleaning device when said protective covering is open and holds the cleaning device firmly when said protective covering is closed.

3. The printing machine according to claim 2, wherein said protective covering is equipped with a first guide, and with a second guide constructed for inserting the cleaning device into the printing machine, said first guide being constructed for pushing the cleaning device onto said protective covering and for inserting the cleaning device into said second guide, said first guide and said second guide being aligned in mutually intersecting directions.

4. The printing machine according to claim 3, wherein said aligned first and second guides substantially perpendicularly abut one another.

5. The printing machine according to claim 3, wherein the cleaning device is constructed as a carriage which is slidable on said first guide and rollable on said second guide.

6. The printing machine according to claim 2, wherein the fixing device is constructed as a linkage formed as a double rocker mechanism.

7. The printing machine according to claim 6, wherein said double rocker mechanism includes a drive rocker arm formed by said protective covering.

8. The printing machine according to claim 6, wherein said double rocker mechanism includes a drive rocker arm swivellably coupled with said protective covering.

9. The printing machine according to claim 6, wherein said double rocker mechanism includes a driven rocker arm whereon a first latching element is disposed which, depending upon a swivelling direction of said driven rocker arm, is bringable due to the swivelling of said driven rocker arm into and out of engagement, respectively, with a second latching element formed on the cleaning device.

10. The printing machine according to claim 6, wherein said double rocker mechanism includes a drive rocker arm formed as an angular rocker.

11. The printing machine according to claim 9, including a third guide for guiding the cleaning device as the cleaning device is being inserted, said third guide being formed on a side of the printing machine, and a first guide pin guidable by said third guide and fastened to the cleaning device, said first guide pin in a dual function also forming said second latching element.

12. The printing machine according to claim 11, including a second guide pin having a larger diameter than that of said first guide pin, said second guide pin being fastened, in addition to said first guide pin, to the cleaning device, and being disposed downline from said first guide pin in an insertion direction.

* * * * *